US006283721B1

(12) United States Patent
Göllner

(10) Patent No.: US 6,283,721 B1
(45) Date of Patent: Sep. 4, 2001

(54) PRODUCTION OF HYDROSTATIC AXIAL PISTON MACHINES BY MEANS OF STEPPER MOTORS

(75) Inventor: Wilhelm Göllner, Neumünster (DE)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/383,751

(22) Filed: Aug. 26, 1999

(30) Foreign Application Priority Data

Sep. 14, 1998 (DE) ..... 198 42 029

(51) Int. Cl.[7] ..... F04B 1/26

(52) U.S. Cl. ..... 417/222.1; 91/506; 92/12.2

(58) Field of Search ..... 417/222.1, 269, 417/218; 91/506, 485, 387; 92/12.2; 180/327; 60/329; 137/596.2

(56) References Cited

U.S. PATENT DOCUMENTS 4,142,452 * 3/1979 Forster et al. ..... 91/506
4,483,663 * 11/1984 Myers ..... 417/222.1
4,991,492 * 2/1991 Bratt et al. ..... 92/12.2
6,048,176 * 4/2000 Deininger ..... 417/222.1
6,155,798 * 12/2000 Deininger et al. ..... 417/222.1

FOREIGN PATENT DOCUMENTS 196 08 228 A1 9/1997 (DE) .
197 53 866 A 1 8/1998 (DE) .

* cited by examiner

*Primary Examiner*—Teresa Walberg
*Assistant Examiner*—Quang Van
(74) *Attorney, Agent, or Firm*—Zarley, McKee, Thomte, Voorhees & Sease

(57) ABSTRACT

A description is given of an adjustable hydrostatic axial piston machine whose angle can be varied by means of a servo-piston (9) to which actuating pressure can be applied and which is connected to an electrohydraulic control valve. The control valve has a control piston (15) and a control sleeve (22) which can be moved axially relative to one another. The control piston (15) can be axially adjusted with a stepper motor (10), and the control sleeve (22) is coupled mechanically or hydraulically to an adjusting mechanism (9, 7) for the angle for the purpose of feeding back the angle.

3 Claims, 8 Drawing Sheets

PRODUCTION OF HYDROSTATIC AXIAL PISTON MACHINES BY MEANS OF STEPPER MOTORS

BACKGROUND OF THE INVENTION

Variable hydrostatic axial piston machines of swash plate design have a cylinder block and a swash plate whose angle, and thus whose flow of hydraulic fluid, can be varied by means of a servo-piston to which actuating pressure can be applied. Typically, the servo-piston is hydraulically connected to an electrically driven valve. The valve is driven electrically, for which purpose it is customary to use proportional solenoids which are designed to act directly or as so-called nozzle-flapper valves which are designed to act as a pilot control. A version with pilot control is described in U.S. Pat. No. 5,205,201. In the case of variable displacement pumps, this is usually an angle of 0 degrees, whereas in the case of variable displacement motors it is either the maximum or minimum angle.

For special applications, in particular in the case of drive systems with variable displacement motors connected to fast driving vehicles, a good provision is not made in existing equipment to maintain the instantaneous angle in the case of failure of the electronic system or the electronic connection to the adjusting device.

An adjusting device with a stepper motor for a hydrostatic axial piston machine is described in DE 196 08 228 A1. In this known system, a rotary slide valve is operationally connected to a stepper motor. In this known system, the angle is fed back via levers to a rotary sleeve. The disadvantage with this system is that it is necessary to provide a complicated connection, which is free from play to the greatest possible extent, between the swash plate and the control sleeve, as well as to provide a gear between the control slide valve and the stepper motor, since the resolution of the stepper motor is insufficient. This means that the known system is of complicated design and expensive.

Furthermore, U.S. Pat. No. 4,290,447 describes an electrohydraulically proportional valve with an actuator comprising a linear power motor, a valve piston and an axially displaceable valve sleeve. Proportionality between current and force is characteristic of the linear power motor. Providing a spring in the linear motor means that the forces of the motor are in equilibrium with the spring force, as a result of which the force is proportional to the displacement. The tolerances of the springs and the tolerances of the magnetic air gaps are disadvantageous for these known systems. Moreover, the displacement of the linear power motor depends strongly on the friction of the valve piston, on the friction of the fit between the slide valve and the bore, as well as on the pollution in the gap. Furthermore, the magnetic hysteresis of the linear power motor influences the operational performance of such known axial piston machines.

Therefore, it is the object of the invention to create an adjustable hydrostatic axial piston machine in which the adjusting mechanism for the angle is of simple design and operates free from hysteresis to the greatest possible extent in an exactly reproducible fashion over the entire operating range.

SUMMARY OF THE INVENTION

A servo-piston to which actuating pressure can be applied can be used to vary the angle of a swash plate type of bent axis type hydrostatic axial piston machine. The servo-piston is connected to an electrohydraulic control valve which has a control piston and a control sleeve which can be moved axially relative to one another where the control valve implements an electrohydraulic proportional control system. The control piston is connected to a stepper motor so that the control piston and the control sleeve can be displaced axially relative to one another. The stepper motor is driven electronically. The control sleeve is mechanically coupled to the adjusting mechanism for the angle for the purpose of feeding back the swash angle.

In accordance with the preferred embodiment, the servo-piston is mechanically connected to a cylinder block of the axial piston machine via a spindle and a valve segment. The control piston/control sleeve assembly is supported in this case on the servo-piston which, for its part, is operationally connected to the spindle, which produces the connection to the cylinder block of the axial piston machine via a valve segment.

In accordance with a further aspect of the invention, in the case of the adjustable hydrostatic axial piston machine of bent axis design or swash plate design the angle thereof can be varied or adjusted by means of a servo-piston to which an actuating pressure can be applied. For its part, the servo-piston is connected to an electrohydraulic control valve whose control piston and control sleeve can be moved axially relative to one another. According to the invention, the control piston can be adjusted axially by means of a stepper motor, and the control sleeve is supported in a fashion loaded by fluid pressure on an adjusting mechanism for the swash angle, in order to feed back the angle, and executes an axial relative movement in the event of a change in the swash angle. A fluid pressure, preferably pressurized hydraulic oil, acts in this case on the control sleeve such that the latter is supported on the adjusting mechanism for the swash angle. Supporting the control sleeve on the adjusting mechanism for the swash angle means that the swash angle is fed back and that in the event of a change in the swash angle the control sleeve executes an axial stroke movement. However, it is also possible to apply a spring to the control sleeve.

It is preferable to use a yoke as the adjusting mechanism for the angle. The advantage of implementing the feedback of the swash angle by means of a yoke resides, in particular, in applications which require very large ranges of angles of adjustment such as, for example, ±45 degrees.

In accordance with a further embodiment, the adjusting mechanism for the angle is a valve segment connected to a cylinder block. The flow of hydraulic oil, which depends on the angle, to the axial pistons in the cylinder block of the axial piston machine (axial piston motor) and/or the hydraulic oil returning from the cylinder block (axial piston pump) are realized through the valve segment. The valve segment preferably has an inclined surface by means of which a stroke movement of the control sleeve is performed for the purpose of feeding back the position of the angle. This inclined surface represents a particularly simple and reliable design which permits an exactly reproducible adjustment, free from hysteresis to the greatest possible extent, of the angle by means of the adjusting mechanism for the angle, in conjunction with a simple design. The adjusting device with the valve segment permits the swash angle to be adjusted in an absolute fashion up to approximately 30° max.

In accordance with yet another embodiment of the invention, the adjusting mechanism for the angle is a swash plate. This is a position control with displacement feedback and driven by means of the stepper motor for the adjustable axial piston machine in swash plate design.

In a way known per se, the stepper motor has a rotor which preferably acts directly on a motion transmitting screw thread in such a way that when the stepper motor rotor rotates it is possible to generate axial movement which can be transmitted to the control piston. The electronic drive of the stepper motor in the form of steps, which can be performed very accurately and very precisely, thereby also effects a very precise, exactly reproducible axial movement of the control piston, which controls the adjusting mechanism for the swash angle so as to set desired and/or required angles exactly.

The control sleeve is preferably supported in a spring-loaded or pressure-loaded fashion on the adjusting mechanism for the swash angle in such a way that the control sleeve executes an axial stroke movement when the swash angle changes. That is to say, the control sleeve and control piston can be moved relative to one another and axially in each case.

The control piston is preferably designed in such a way and co-operates with the control sleeve in the case of axial displacement in such a way that control edges present on the control piston uncover openings in the control sleeve for a flow of oil to the servo-piston, as a result of which the position of the servo-piston, and thus of the swash angle, is changed until the control edges are closed again by the movement of the control sleeve in the same direction. This provides the desired proportionality between an electronically prescribed step of the stepper motor and the change in the swash angle. The control piston is preferably supported on the stepper motor in a spring-loaded or pressure-loaded fashion.

The system of the invention exhibits a proportional behavior of the change in the swash angle and the electronically prescribed step of the stepper motor. This operating principle has substantial advantages with regard to the adaptability to today's axial piston machines of bent axis design. Substantial advantages consist, inter alia, in that there is no need for extensive changes to the mass-produced components of the respective axial piston machines. Rather, all that is required is a mechanical adaptation of the stepper motor to the endcap of the variable displacement motor. This renders it possible for known axial piston machines also to be easily retrofitted with the adjusting mechanism according to the invention.

DESCRIPTION OF THE PREFERRED EMBODIMENT

Figure 1:
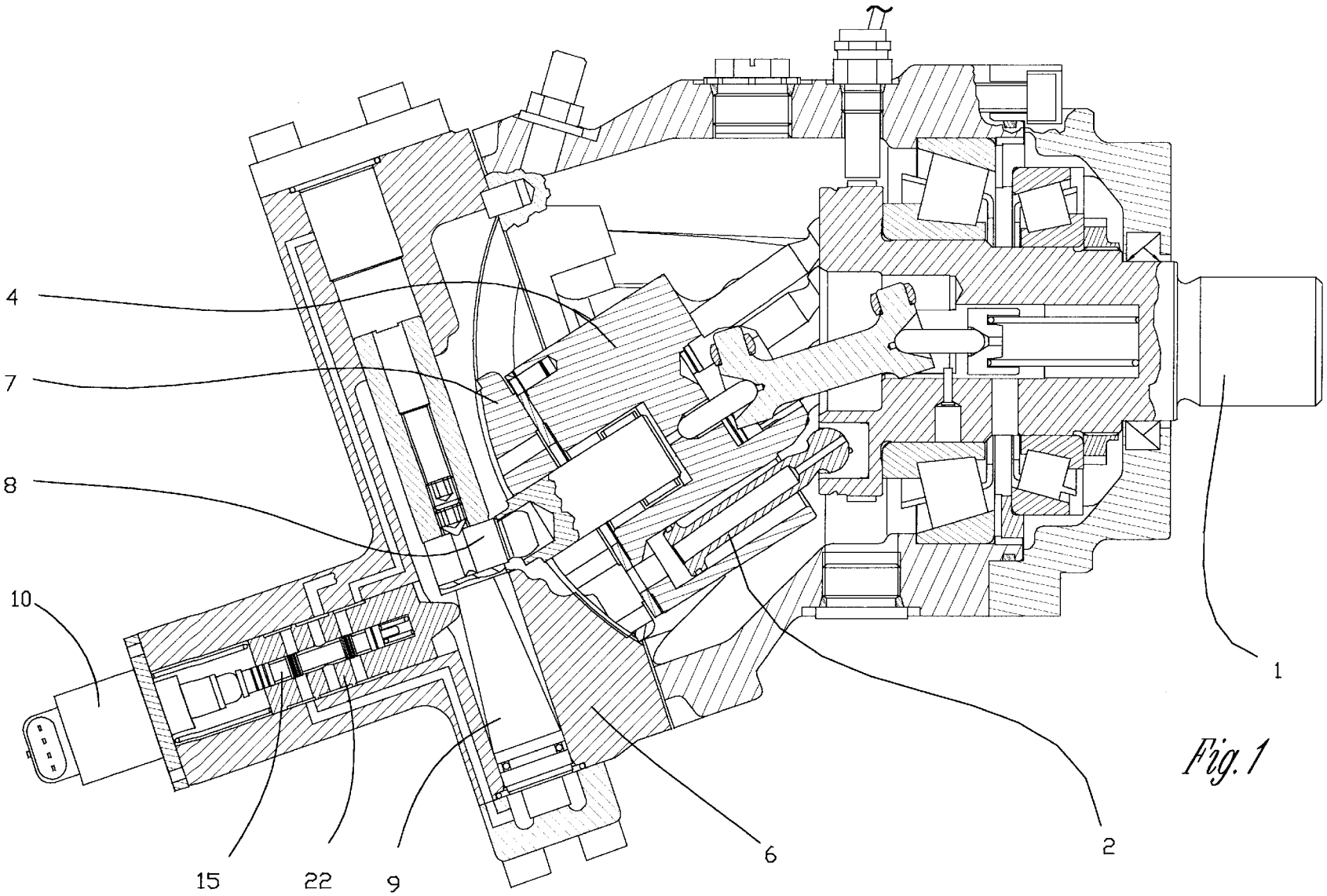
FIG. 1 shows a cross section through an axial piston variable displacement motor of bent axis design with driving of the adjusting mechanism for the angle by means of a stepper motor.

FIG. 1 shows a cross-sectional view of an axial piston motor according to the invention in accordance with a first exemplary embodiment of the invention, in which the adjustment of the angle is implemented by driving by means of a stepper motor. This adjustment is an electrically proportional servo control.

The adjustable axial piston motor is supplied by means of pressurized hydraulic oil which is led by a delivery pump (not shown) via appropriate connecting lines to the endcap 6 of the variable displacement motor. The hydraulic oil is connected via a valve segment 7 to axial pistons 2 arranged in a cylinder block 4. A shaft 1 of the variable axial piston motor is mechanically connected to the axial pistons 2 of the rotating group. When pressurized hydraulic oil is applied to them, these axial pistons 2 exert a torque on the shaft 1 of the axial piston motor.

Figure 2:
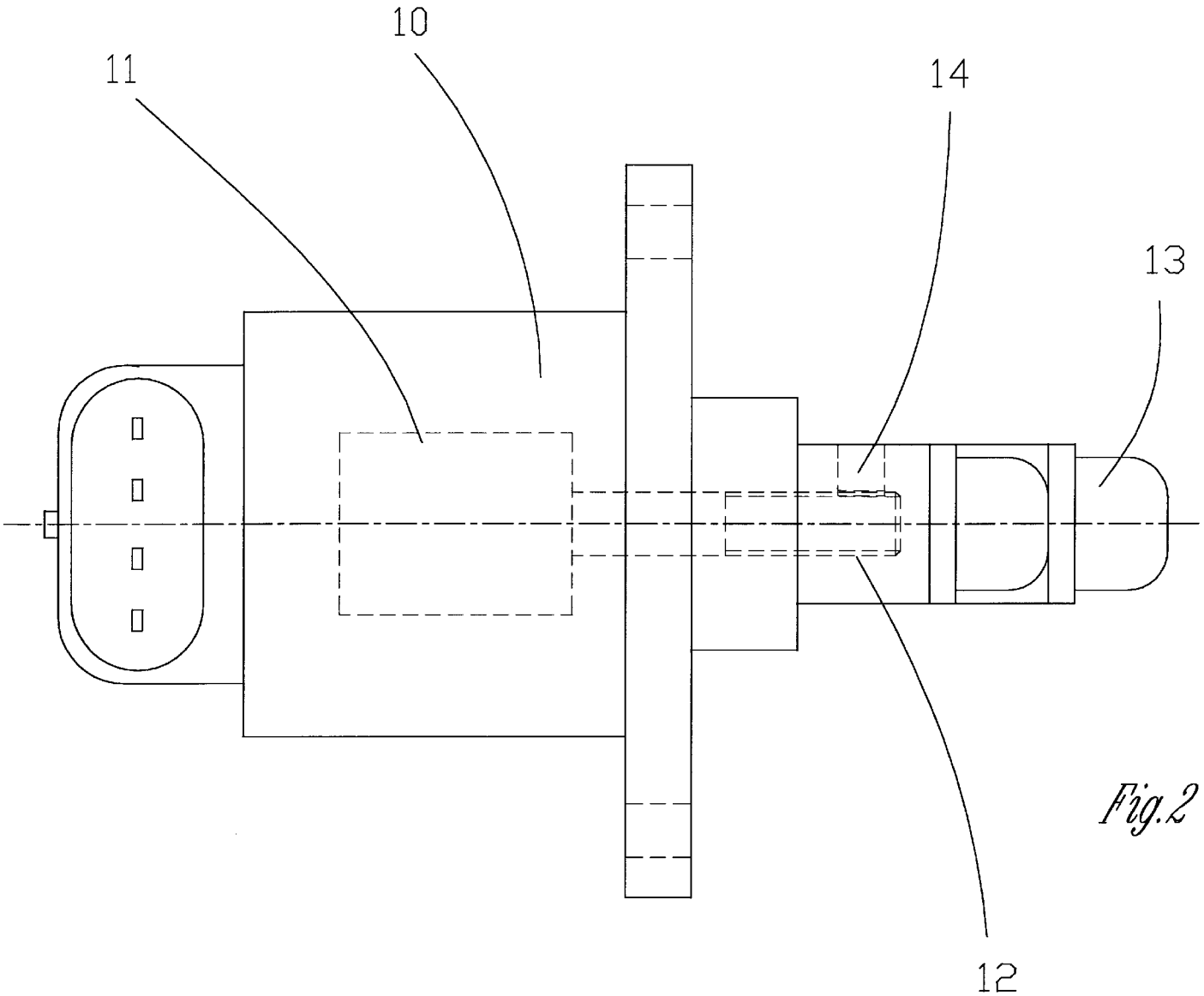
FIG. 2 shows a representation of the principle of a stepper motor used for an axial piston motor according to the invention.

The swash angle is varied by means of a servo-piston 9 which is connected to the cylinder block 4 via a spindle 8 and the valve segment 7. The position of the servo-piston 9, and thus the magnitude of the angle, is set by means of a control valve which has a control sleeve 22 and a control piston 15 which is also denoted as a control slide valve. A stepper motor 10 is driven via an electronic drive circuit such that it carries out a desired number of steps or also half steps depending on the design of the drive circuit. The stepper motor 10 has a rotor 11 which rotates in a fashion proportional to the number of steps (see FIG. 2). Depending on the type and design of the stepper motor, this is a range of 60 degrees or 1.8 degrees per full step. The angle of rotation, corresponding to one step, of the rotor 11 of the stepper motor 10 depends on the design of the stepper motor respectively used. It is also possible to execute, for example, half steps or quarter steps by means of tailored drive sequences which are provided by the electronic system. At its output end, the rotor 11 of the stepper motor has a motion transmitting screw thread 12. A rod 13 is coupled in a rotationally secure fashion to the housing of the stepper motor 10 by means of a slot/key connection, and is designed as a nut 14 (FIG. 2). As a result, rotation of the rotor 11 of the stepper motor 10 produces an axial movement of the rod 13.

Figure 3:
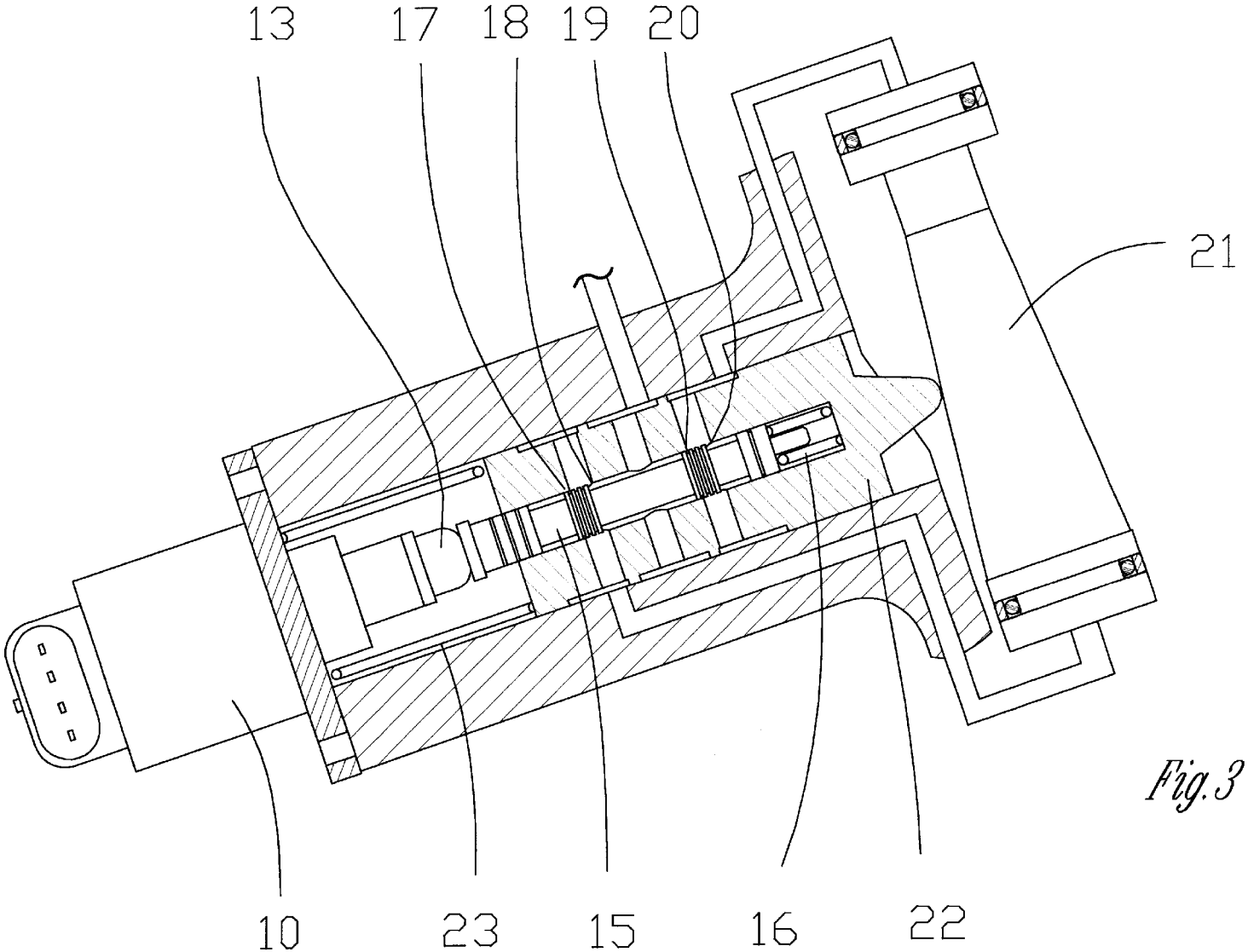
FIG. 3 shows a mechanism for adjusting the angle as position control with displacement feedback via a control sleeve.

FIG. 3 shows a detailed view in accordance with the embodiment of FIG. 1. The position control with displacement feedback for adjusting the angle of an axial piston motor is accomplished with feedback via a control sleeve. The control piston 15 is permanently pressed by a spring 16 against the ram 13 of the stepper motor. As a result, the control piston 15 is axially displaced when the rotor 11 of the stepper motor 10 rotates. Along its length, the control piston 15 has a plurality of control edges 17, 18, 19 and 20. By means of the volumetric flow over the control edges, which cooperate with openings or channels in the control sleeve 22, the servo-piston 9 is displaced to control sleeve 22. The control sleeve 22 is pressed by means of a compression spring 23 against a cone of the servo-piston 9, and is displaced in the axial direction which is in the same direction as the control piston 15, and until the control edges 17, 18, 19 and 20 reclose. The control sleeve 22 has a projection which is seated on the cone of the servo-piston 9. Axial displacement of the control piston 15 as a consequence of the rotary movement of the rotor 11 of the stepper motor 10 displaces the servo-piston 9. The longitudinal axis of the servo-piston is essentially aligned perpendicular to the longitudinal axis of the control piston 15, along its longitudinal axis. As a result thereof, the adjusting mechanism for the swash angle is correspondingly acted upon to change the swash angle. Thus, this control valve, which is controlled by control edges, produces proportionality between a step of the stepper motor 10 and a change in the angle. This principle of the adjustment is termed electric position control with displacement feedback.

In this arrangement, the control sleeve is preferably supported in a spring-loaded fashion on the adjusting mechanism for the swash angle in such a way that it executes a corresponding axial stroke movement when the swash angle changes. The control piston is supported in a spring-loaded fashion on a stepper motor or is connected via a spring to the output side of the stepper motor, and can thereby be adjusted in the axial direction. The supply of hydraulic oil to the servo-piston is controlled by means of the control piston so that the position of servo-piston, and thus of the swash angle, is varied until the supply of oil to the servo-piston is interrupted again by the movement of the control sleeve in the same direction. A substantial advantage of such a system consists in that it concerns an extremely simple, electrically proportional adjustment. In addition, there are substantial functional advantages by contrast with conventional systems such as elimination of hysteresis and temperature sensitivity, as well as an increase in precision.

Figure 4:
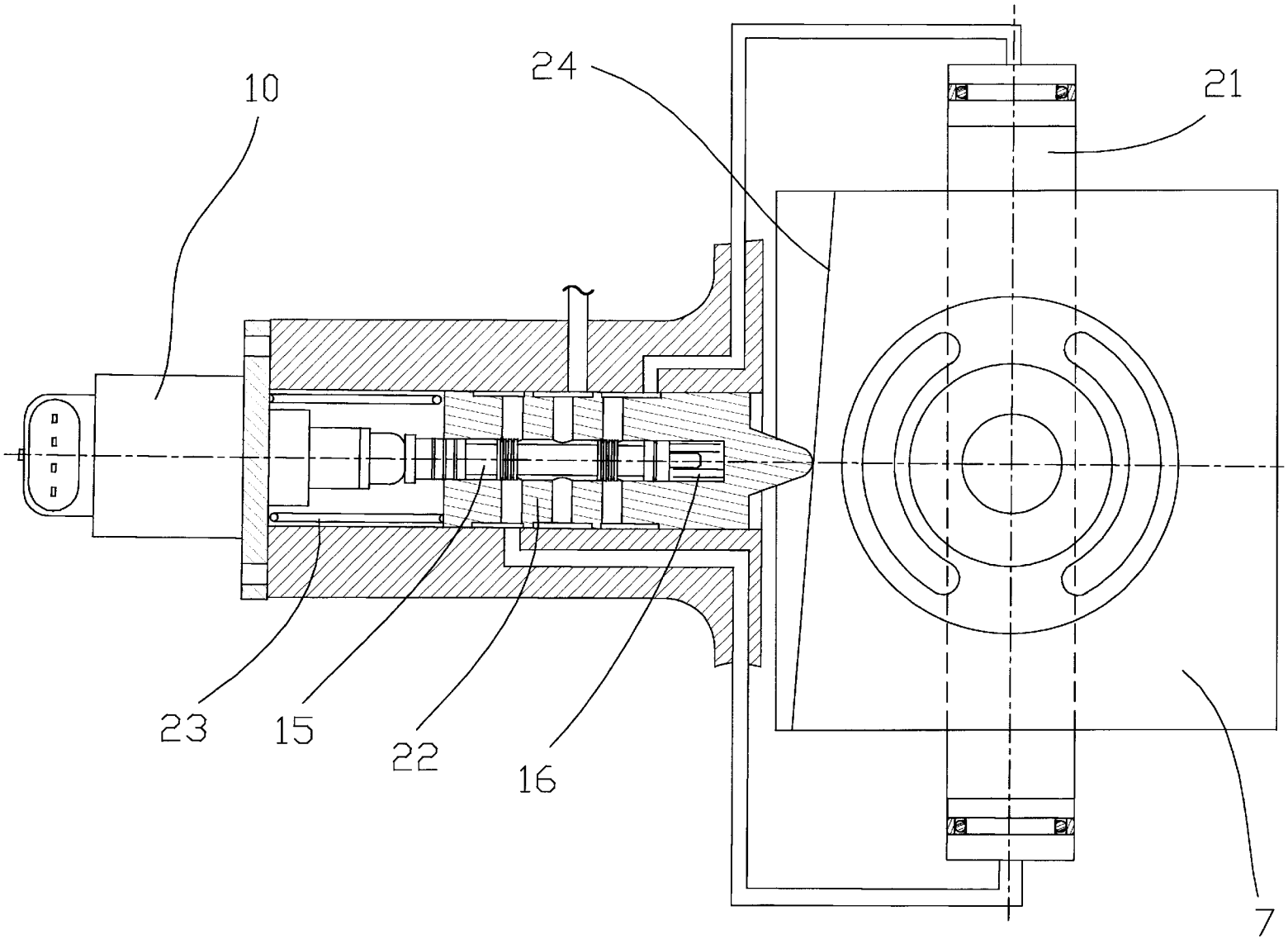
FIG. 4 shows a mechanism for adjusting the angle of the axial piston motor according to the invention as position control with displacement feedback via a valve segment.

FIG. 4 represents a first alternate embodiment for adjusting the angle of an axial piston motor. Instead of the connection between the control sleeve 22 and the servo-piston 21 in accordance with the arrangement in FIGS. 1 to 3, a connection is provided between a control sleeve 22 and a valve segment 7. The principle of the functioning of the actual adjustment of the control piston 15 or control sleeve 22 corresponds to that described in connection with FIGS. 1 to 3, and so no further detail on this will be considered. In the embodiment of FIG. 4, an inclined surface 24 is provided on a lateral surface of the valve segment 7. As the rotor 11 of the stepper motor 10 rotates, this results in the production of a stroke movement of the control piston 15 and, subsequently, of the control sleeve 22, which is supported on the inclined surface 24 by means of a projection designed in a similar way to the arrangement of FIG. 3.

Figure 5:
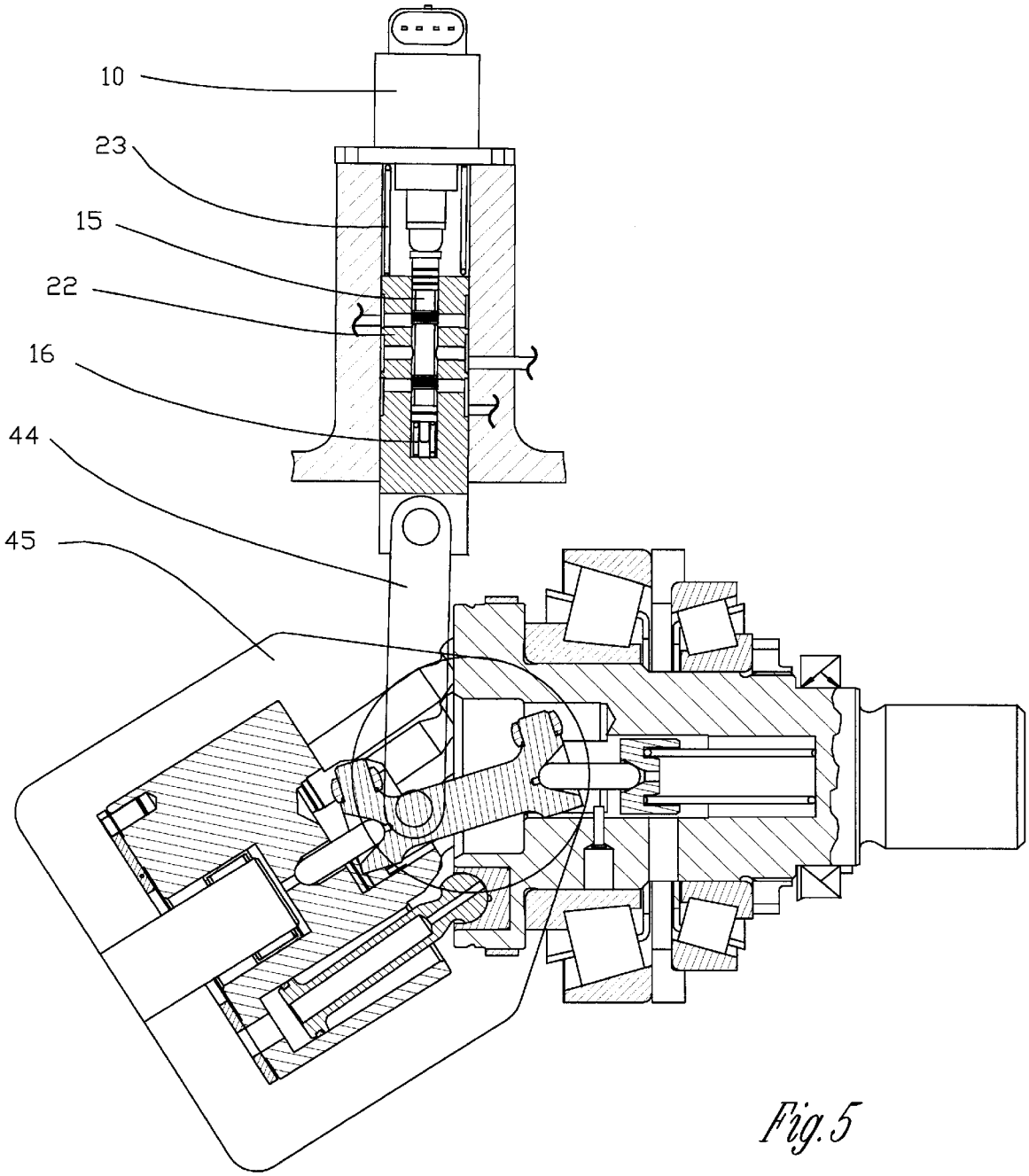
FIG. 5 shows a mechanism for adjusting the angle of an axial piston machine according to the invention as position control with displacement feedback via a yoke.

A second embodiment of an adjusting mechanism for the angle designed as a yoke 45 and intended for an axial piston machine according to the invention is shown in FIG. 5. The feedback is implemented in this case via the yoke 45 of the adjusting system. Such an adjusting mechanism for the angle is useful and appropriate when there is a need for adjustment over very large angular ranges. For example, ±45 degrees. Thus, the desired adjustment can be implemented over large angular ranges via the yoke 45, to which a connecting element 44 is eccentrically pivoted with the control sleeve 22, via such a described crank mechanism. The actual functioning of the control valve, which has the control sleeve 22 and the control piston 15 and is acted upon by the stepper motor 10, corresponds to that of the previously described exemplary embodiments, and will therefore not be described in more detail at this juncture. The control piston 15 is supported against a spring 16, while the control sleeve 22 is supported against a spring 23.

Figure 6:
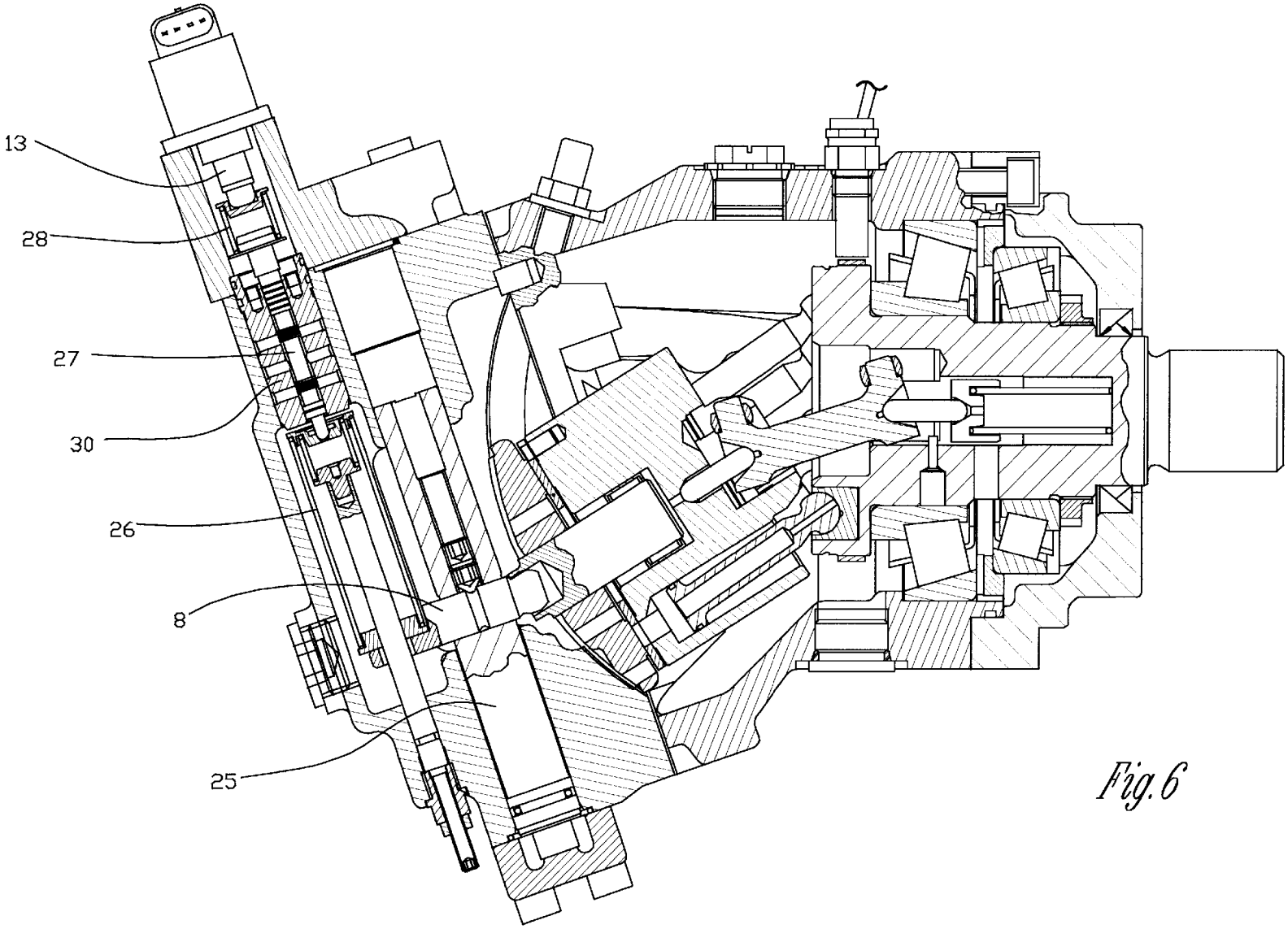
FIG. 6 shows a mechanism for adjusting the angle of an axial piston motor according to the invention as position control with force feedback and driving by means of a stepper motor.

A further third embodiment of the invention is represented in FIG. 6 in the form of position control with force feedback and driving by means of a stepper motor. The angle of this variable unit is transmitted to a spring 26 via the connection 8 (see also FIG. 1). The spring force is indirectly proportional to the angle. A large angle signifies a small spring force, whereas a small angle signifies a large spring force. This force is transmitted onto a control piston 27, which is arranged in an axially movable fashion in a stationary control sleeve 30 and is provided with control edges (see FIG. 3), and is in equilibrium with the force of a further spring 28. In the event of a step by the stepper motor 10, as a result of which the ram 13 is moved in the axial direction, the spring force of the spring 28 changes. The control piston 27 is displaced, in order to maintain an equilibrium of forces between the two springs 26, 28. As a result, the control edges are opened with respect to the openings or channels provided in the control sleeve 30. This is attended by an adjustment of the servo-piston 25 and an increase in the spring forces 26 and 28, until the control piston 27 reseals the openings in the control sleeve 30 by means of the control edges. In this system, the control sleeve 30 is fixed and cannot be displaced axially. Such a system likewise implements a proportional behavior between change in the angle of the axial piston motor and a step of the stepper motor 10. Particular advantages of this operating principle consist in the ease of adaptation to existing axial piston variable displacement motors of bent axis design. Consequently, mass-produced components of current axial piston motors require no substantial design changes or adaptation work. Only a mechanical adaptation of the stepper motor to the endcap 6 of the variable displacement motor is required.

Figure 7:
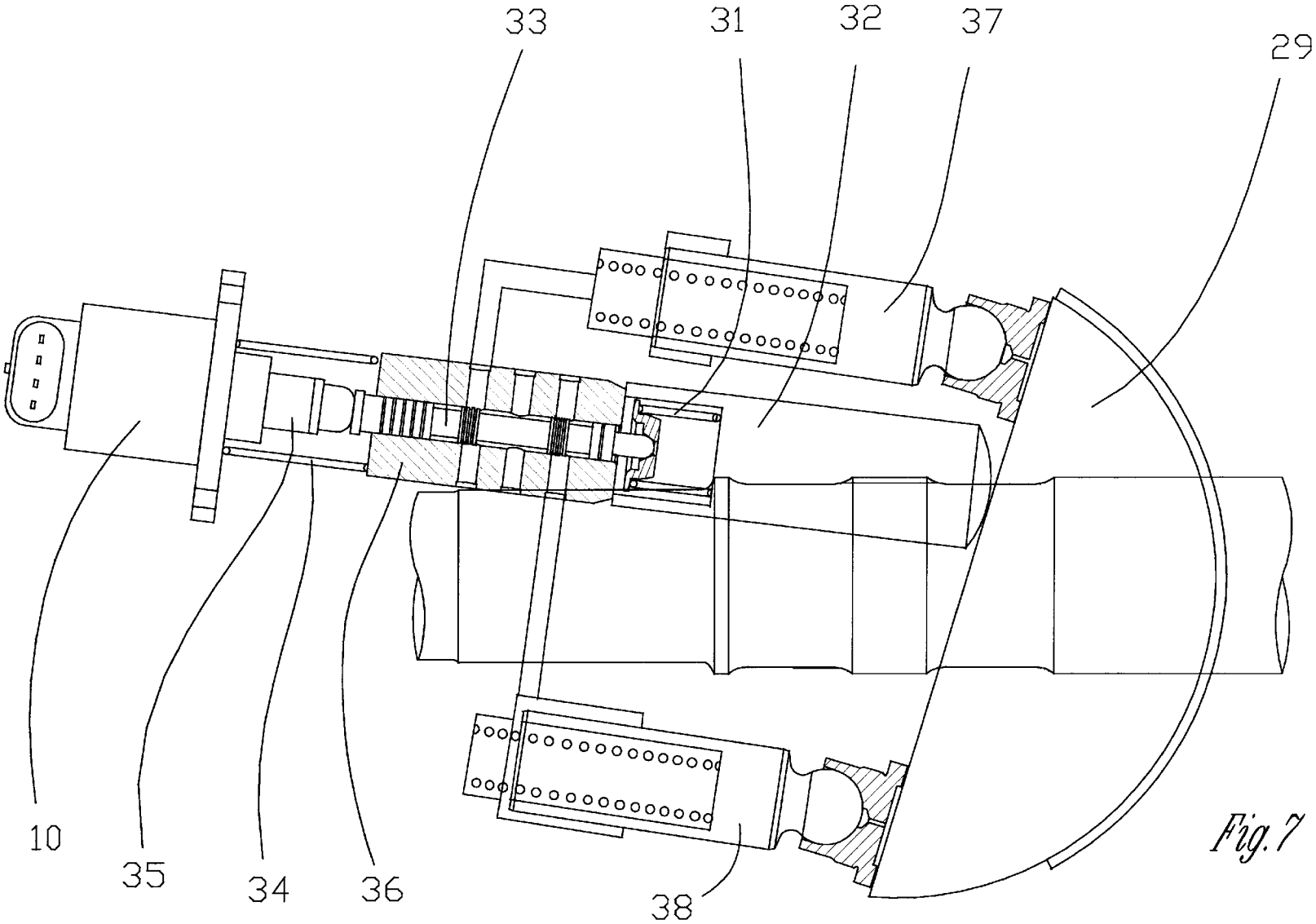
FIG. 7 shows a mechanism for adjusting the swash angle of an axial piston motor according to the invention as position control with displacement feedback and driving by means of a stepper motor, in accordance with a further exemplary embodiment.

A fourth embodiment of the invention shown in FIG. 7 in which position control with displacement feedback and driving is accomplished by means of a stepper motor. It is shown in conjunction with an adjustable axial piston machine of a bent axis design. By contrast with the connection of the control sleeve to the servo-piston (see FIG. 1) or to the valve segment 7 (FIG. 4), a connection direct to the swash plate 29 is shown here. The control sleeve 36 is pressed against the flat surface of the swash plate 29 by a spring 34 via a ram 32. The control piston 33 is pressed against a ram 35 of the stepper motor 10 by a spring 31. The control sleeve 36 is hydraulically connected to adjusting pistons 37, 38, in order to produce an appropriate change in the swash angle of the swash plate 29. The cooperation between the stepper motor 10, the control piston 33 and the control sleeve 36 is similar to that described in conjunction with the other embodiments (see FIGS. 1 to 3). As an alternative, the feedback of the swash angle can also be performed via the servo-piston 9, in a way similar to that represented in FIG. 1.

Figure 8:
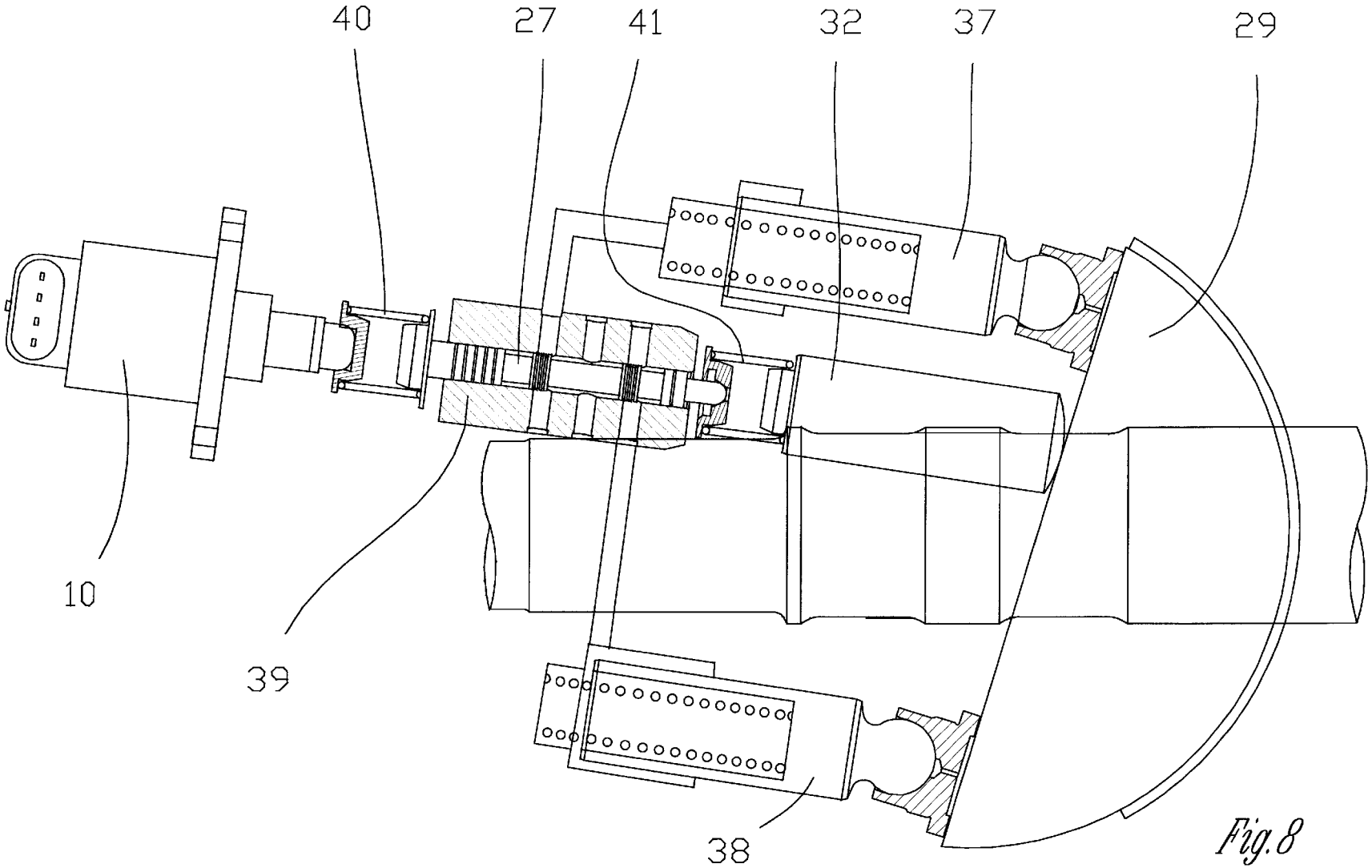
FIG. 8 shows a mechanism for adjusting the swash angle of an axial piston motor according to the invention in accordance with a further exemplary embodiment of the invention as a mechanism with displacement/force control and driving by means of a stepper motor.

A further embodiment of the invention is shown in FIG. 8. The functioning thereof is similar to that in FIG. 6. The control concept represented is electric position control of the adjustable axial piston motor with force feedback on the basis of a swash plate design 29. For this purpose, the control valve is connected on one side with respect to the stepper motor 10, and on the other side with respect to the ram 32 by means of spring elements 40, 41.

All the embodiments described for adjusting the angle are suitable equally for variable displacement motors and for variable displacement pumps of axial piston design. This holds for bent axis design and for swash plate design.

What is claimed is:

1. Adjustable hydrostatic axial piston machine whose angle can be varied by means of a servo-piston (9; 21; 25; 37; 38) to which actuating pressure can be applied and which is connected to an electrohydraulic control valve whose control piston (15; 27; 33) and control sleeve (22; 30; 36; 39) can be moved axially relative to one another, characterized in that the control piston (15; 27; 33) can be adjusted axially by means of a stepper motor engaging a motion transmitting screw that extends axially with respect to the control piston, and the control sleeve (22; 36) is supported in a fashion loaded by fluid pressure on an adjusting mechanism for the angle (9; 7; 29) in order to feed back the angle, and executes an axial stroke in the event of a change in the swash angle.

2. Adjustable hydrostatic axial piston machine having a cylinder block (4) and a swash plate (29) whose angle can be varied by means of a servo-piston (9; 21; 25; 37; 38) to which actuating pressure can be applied and which is connected to an electrohydraulic control valve, the control valve having a control piston (15; 27; 33) and a control sleeve (22; 30; 36; 39), which can be moved axially relative to one another, characterized in that the control piston (15; 27; 33) can be adjusted axially by means of a stepper motor (10), and the control sleeve (22; 36) is mechanically coupled to an adjusting mechanism for the angle (9; 7; 29) for the purpose of feeding back the angle; and the stepper motor (10) has a rotor (11) which acts directly on a transmitting screw (12) in such a way that an axial movement is generated when the stepper motor rotor rotates.

3. An adjustable hydrostatic axial piston machine having a cylinder block (4) and a swash plate (29) whose angle can be varied by means of a servo-piston (9; 21; 25; 37; 38) to which actuating pressure can be applied and which is connected to an electrohydraulic control valve, the control valve having a control piston (15; 27; 33) and a control sleeve (22; 30; 36; 39), which can be moved axially relative to one another, characterized in that the control piston (15; 27; 33) can be adjusted axially by means of a stepper motor (10), and the control sleeve (22; 36) is mechanically coupled to an adjusting mechanism for the angle (9; 7; 29) for the purpose of feeding back the angle; the control sleeve (22; 36) is supported in a spring-loaded fashion on the adjusting mechanism for the angle (9; 7; 29) in such a way that said control sleeve executes a axial stroke movement when the angle changes; and the control piston (15; 27; 33) is designed in such a way and cooperates with the control sleeve (22; 36) in the case of axial displacement in such a way that control edges (17; 18; 19; 20) on the control piston (15; 27; 33) uncover openings for a flow of oil to the servo-piston (9; 21; 37; 38) as a result of which the position of the servo-piston, and thus of the angle, is changed until the control edges (17; 18; 19; 20) are closed again by the movement of the control sleeve (32; 36) in the same direction, with the result that proportionality is provided between a step of the stepper motor (10) and the change in the angle.

* * * * *